US006387014B2

(12) United States Patent
Lai

(10) Patent No.: US 6,387,014 B2
(45) Date of Patent: May 14, 2002

(54) FOLDABLE BODY BUILDING DEVICE

(76) Inventor: Fen-Ying Lai, Rm. 39, 2nd floor, No. 2, Kong Yaun Rd., Taichung (TW)

( * ) Notice: Subject to any disclaimer, the term of this patent is extended or adjusted under 35 U.S.C. 154(b) by 0 days.

(21) Appl. No.: 09/797,551

(22) Filed: Mar. 2, 2001

(30) Foreign Application Priority Data

Jun. 9, 2000 (DE) ..... 200 10 379

(51) Int. Cl.[7] ..... A63B 22/04
(52) U.S. Cl. ..... 482/53; 482/908
(58) Field of Search ..... 482/51, 52, 53, 482/57, 62, 148, 70, 71, 908

(56) References Cited

U.S. PATENT DOCUMENTS 5,078,390 A * 1/1992 Hurt ..... 272/70
5,308,301 A * 5/1994 Chiarello ..... 482/53
5,407,407 A * 4/1995 Lin ..... 482/53
5,669,856 A * 9/1997 Liu ..... 482/51
5,746,681 A * 5/1998 Bull ..... 482/53

* cited by examiner

*Primary Examiner*—Stephen R. Crow
(74) *Attorney, Agent, or Firm*—Harrison & Egbert

(57) ABSTRACT

A foldable body building device is formed of a first connection rod mechanism and a second connection rod mechanism. The first connection rod mechanism is formed of an upright rod, a handlebar support rod, two tilted support rods, and a connection rod of a base. The second connection rod mechanism is formed of an upright rod, a handlebar support rod, two damping pressure cylinders, and two swivel rods. The first connection rod mechanism is used to support the body building device in the unfolded state. The second connection rod mechanism is intended to bring about the linking action of the body building device.

1 Claim, 5 Drawing Sheets

FOLDABLE BODY BUILDING DEVICE

BACKGROUND OF THE INVENTION

1. Field of the Invention

The present invention relates generally to a body building device, and more particularly to a foldable body building device.

2. Description of the Related Art

The conventional foldable body building devices are defective in design because they cannot be easily folded and unfolded, and because they are not structurally strong.

BRIEF SUMMARY OF THE INVENTION

The present invention comprises a first connection rod mechanism and a second connection rod mechanism. The first connection rod mechanism is formed of an upright rod, a handlebar support rod, two tilted rods, and a connection rod of a base. The second connection rod mechanism is formed of an upright rod, a handlebar support rod, two damping pressure cylinders, and two swivel rods.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
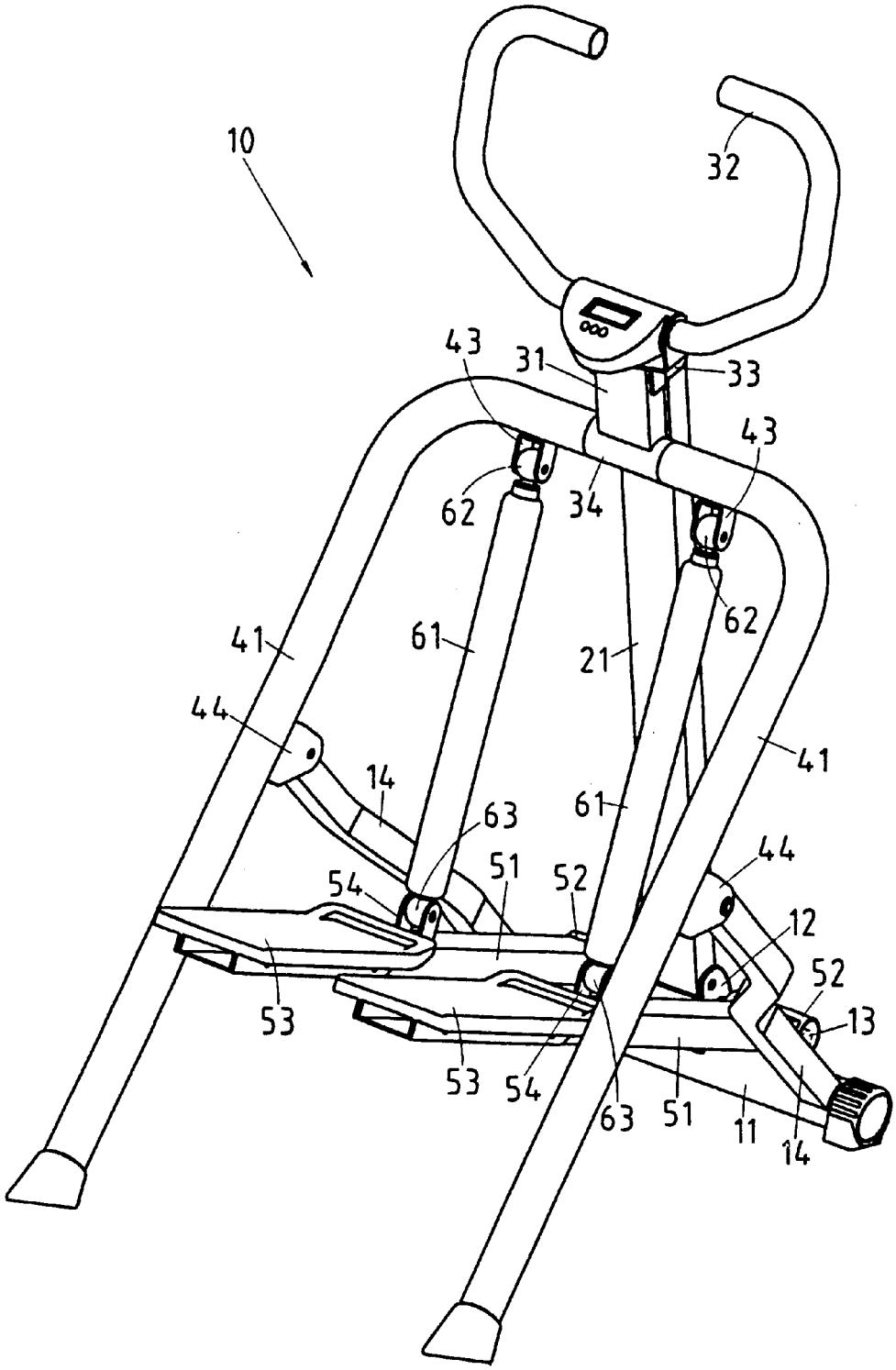
FIG. 1 shows a perspective view of the preferred embodiment of the present invention.
Figure 2:
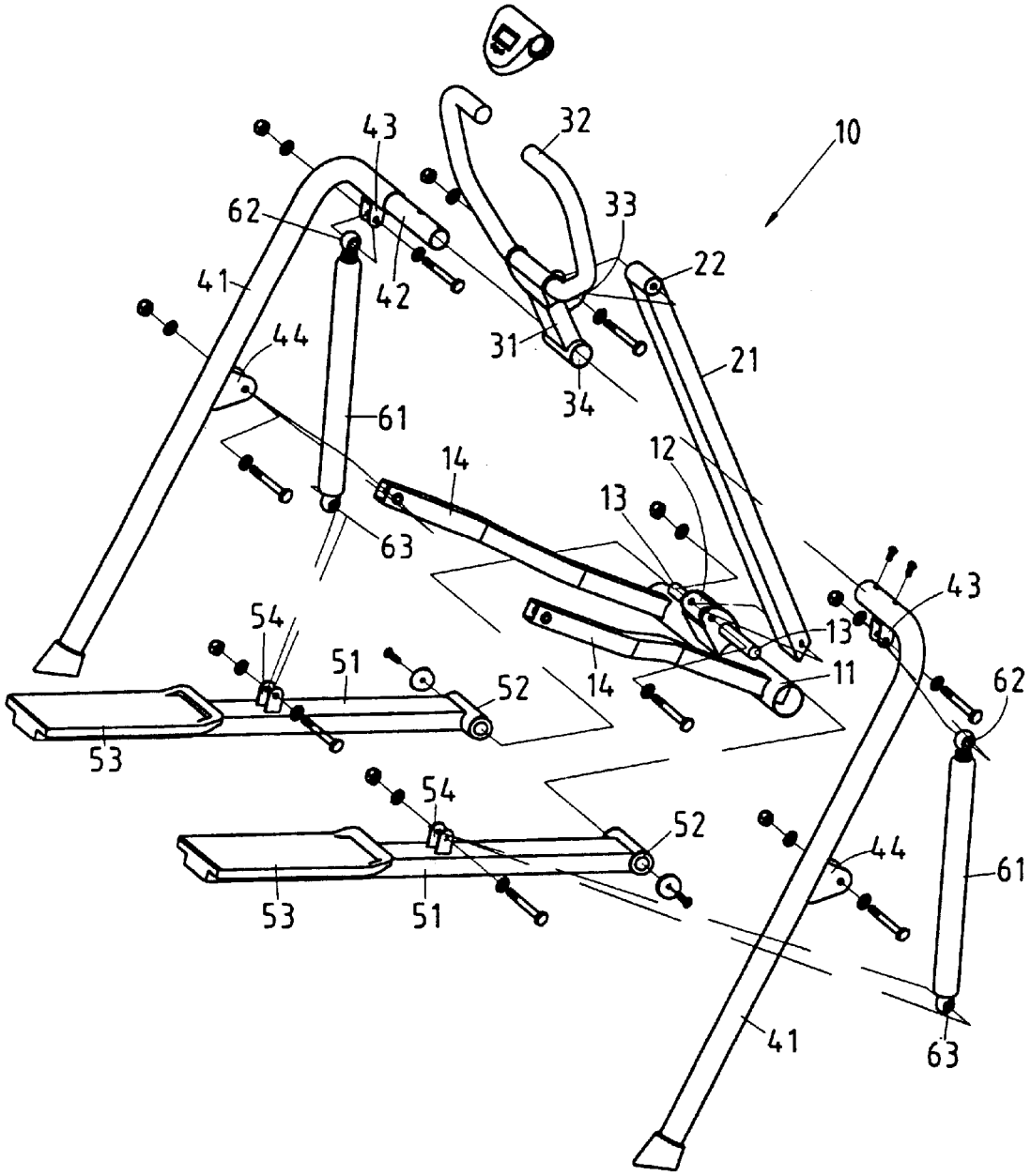
FIG. 2 shows an exploded view of the preferred embodiment of the present invention.
Figure 3:
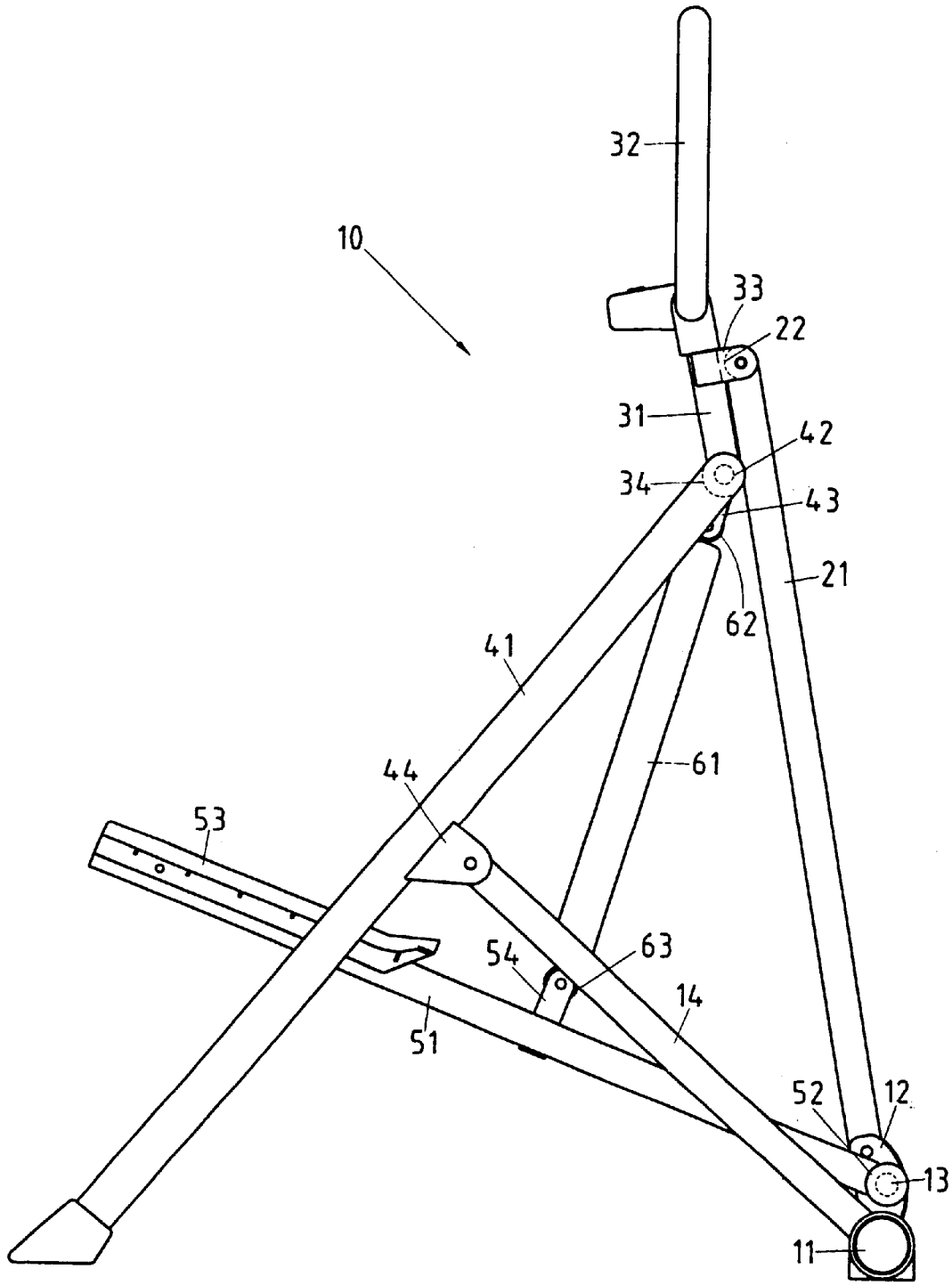
FIG. 3 shows a side view of the preferred embodiment of the present invention.
Figure 4:
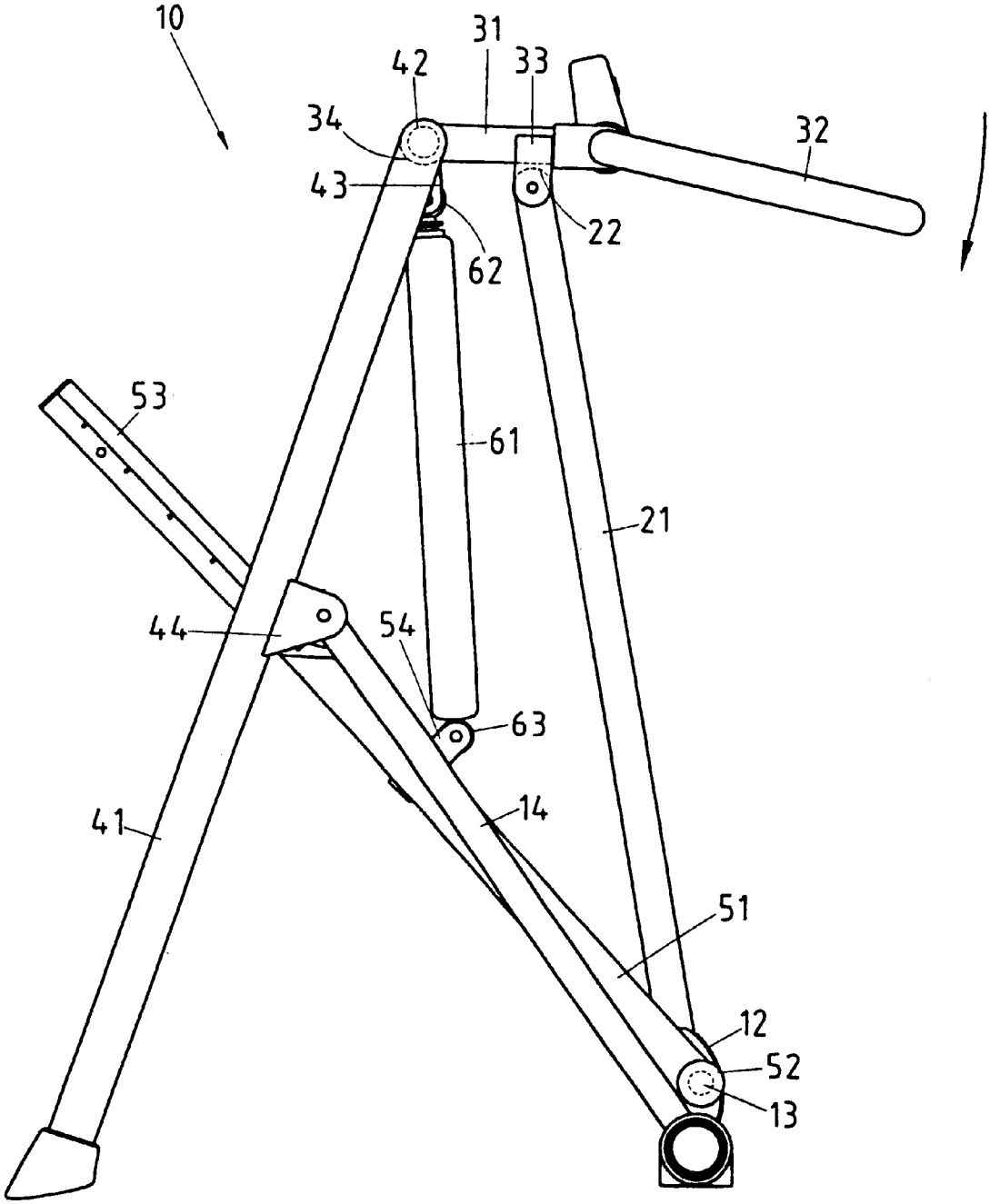
FIG. 4 shows a schematic view of the preferred embodiment of the present invention in the midst of being folded.
Figure 5:
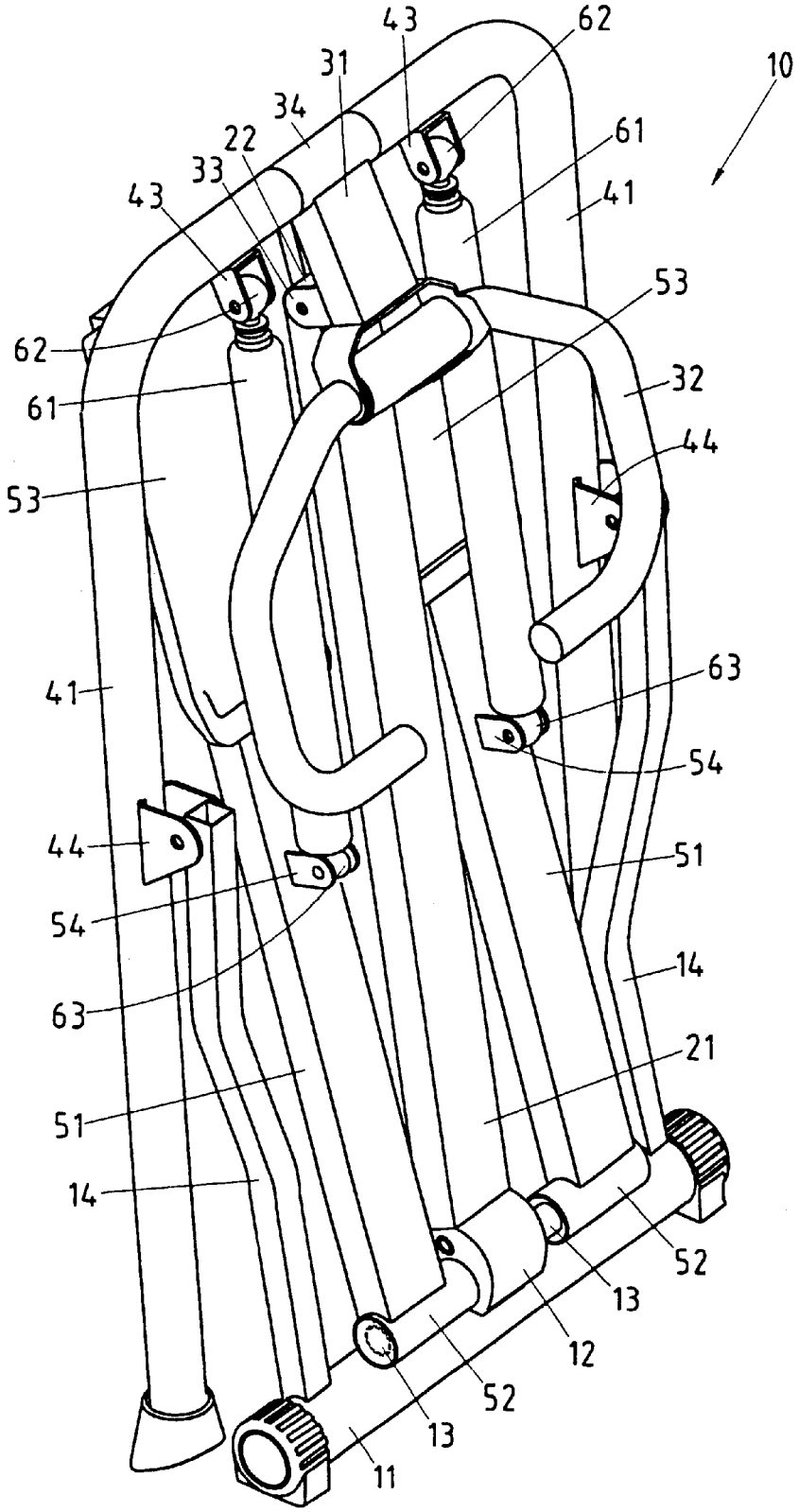
FIG. 5 shows a perspective view of the preferred embodiment of the present invention in the folded state.

As shown in FIGS. 1–5, a body building device 10 embodied in the present invention comprises the component parts which are described hereinafter.

A base rod 11 is provided in the midsegment thereof with a pivoting seat 12 having a shaft rod 13. The base rod 11 is further provided at both ends thereof with a connection rod 14.

An upright rod 21 is provided at the top end thereof with a pivoting seat 22 and is pivoted at the bottom end thereof to the pivoting seat 12 of the base rod 11.

A support rod 31 is provided at the top end thereof with a handlebar 32 and is provided at the top portion with a pivot seat 33 which is pivoted with the pivoting seat 22 of the upright rod 21. The support rod 31 is further provided at the lower end thereof with a pivoting tube seat 34.

Two titled support rods 41 are provided with a connection tube 42 which is pivoted with the pivoting tube seat 34 of the support rod 31, a pivoting suspension seat 43, and a rod pivoting seat 44 connected with the connection rod 14 of the base rod 11.

Two swivel rods 51 are provided at the front end thereof to a pivoting tube portion 52 which is pivoted with the shaft rod 13 of the base rod 11, at the rear end thereof with a pedal board 53, and in the midsegment thereof with a pivoting seat 54.

Two damping cylinders 61 are pivoted at a cylinder end portion 62 thereof to the pivoting suspension seat 43 of the tilted support rod 41, and at a shaft end portion 63 thereof to the pivoting seat 54 of the swivel rod 51.

The connection rod 14 of the base rod 11, the upright rod 21, the support rod 31, and the tilted support rods 41 form together a first connection rod mechanism for supporting the body building device 10 in the unfolded state.

The upright rod 21, the support rod 31, the swivel rods 51, and the damping cylinders 61 form together a second connection rod mechanism for bringing about the linking effect of the body building device 10.

What is claimed is:

1. A foldable body building device comprising:

a base rod provided in a midsegment with a pivoting seat having a shaft rod extending therefrom, said base rod further provided at both ends with a connection rod;

an upright rod provided at a top end with a pivoting seat and pivoted at a bottom end to said pivoting seat of said base rod;

a support rod provided at a top end with a handlebar and a pivot seat whereby said pivot seat is pivoted with said pivoting seat of said upright rod, said support rod further provided at a lower end with a pivoting tube seat;

two tilted support rods provided with a connection tube which is pivoted with said pivoting tube seat of said support rod, said tilted support rods further provided with a pivoting suspension seat and a rod pivoting seat whereby said rod pivoting seat is connected with said connection rod of said base rod;

two swivel rods provided at a front end thereof with a pivoting tube portion which is pivoted with said shaft rod of said base rod, said swivel rods further provided at a rear end with a pedal board, and in a midsegment with a pivoting seat; and two damping cylinders pivoted at a cylinder end portion thereof to said pivoting suspension seat of said tilted support rod, and at a shaft end portion thereof to said pivoting seat of said swivel rod;

wherein said connection rod of said base rod, said upright rod, said support rod, and said tilted support rods comprise a first connection rod mechanism for supporting said body building device in the unfolded state;

and wherein said upright rod, said support rod, said swivel rods, and said damping cylinders comprise a second connection rod mechanism for bringing about the linking effect of said body building device.

* * * * *